US008155508B2

(12) United States Patent
Caine et al.

(10) Patent No.: US 8,155,508 B2
(45) Date of Patent: Apr. 10, 2012

(54) DRYING APPARATUS

(75) Inventors: Joseph Zacary Caine, Kent (GB); Kevin John Simmonds, Somerset (GB); Timothy Alexander French, Wiltshire (GB)

(73) Assignee: Dyson Technology Limited, Malmesbury (GB)

( * ) Notice: Subject to any disclaimer, the term of this patent is extended or adjusted under 35 U.S.C. 154(b) by 726 days.

(21) Appl. No.: 12/159,559

(22) PCT Filed: Jan. 12, 2007

(86) PCT No.: PCT/GB2007/000089

§ 371 (c)(1),
(2), (4) Date: Oct. 16, 2008

(87) PCT Pub. No.: WO2007/080412

PCT Pub. Date: Jul. 19, 2007

(65) Prior Publication Data

US 2009/0034946 A1 Feb. 5, 2009

(30) Foreign Application Priority Data

Jan. 12, 2006 (GB) ..... 0600534.2

(51) Int. Cl.
*A47J 27/00* (2006.01)

(52) U.S. Cl. ..... 392/380; 34/267; 392/379

(58) Field of Classification Search ..... None
See application file for complete search history.

(56) References Cited

U.S. PATENT DOCUMENTS

| | | | |
|---|---|---|---|
| 16,110 | A | 11/1856 | Baldwin |
| 1,258,633 | A | 3/1918 | Heath |
| 1,500,094 | A | 7/1924 | Kee |
| 1,598,660 | A | 9/1926 | Sieben |
| 1,658,489 | A | 2/1928 | Lindstrom |
| 1,688,793 | A | 10/1928 | Schrenkeisen |
| 1,693,308 | A | 11/1928 | Merkowitz |
| 1,704,136 | A | 3/1929 | Lemp |
| 1,830,323 | A | 11/1931 | Judelson et al. |
| 1,961,179 | A | 6/1934 | Tinkham |
| 2,013,572 | A | 9/1935 | McCord |
| 2,104,135 | A | 1/1938 | Morrill |
| 2,109,028 | A | 2/1938 | Miller |

(Continued)

FOREIGN PATENT DOCUMENTS

AU 2005-203363 2/2006

(Continued)

OTHER PUBLICATIONS

GB Search Report mailed Mar. 27, 2006, directed at counterpart GB application No. 0600534.2; 1 page.

(Continued)

*Primary Examiner* — Thor Campbell
(74) *Attorney, Agent, or Firm* — Morrison & Foerster LLP

(57) ABSTRACT

A drying apparatus includes a casing and a cavity formed in the casing for receiving an object to be dried. A fan is located in the casing so as to be capable of creating an airflow, and a motor is provided in the casing for driving the fan. Ducting is provided for carrying the airflow from the fan to at least one opening arranged to emit the airflow into the cavity (12). The ducting includes at least one air duct having a wall in which perforations are provided, and a layer of sound-absorbing material is located on the external surface of the wall so as to cover the perforations. The invention is particularly suitable for use in hand dryers.

17 Claims, 7 Drawing Sheets

U.S. PATENT DOCUMENTS

| | | | |
|---|---|---|---|
| 2,109,704 | A | 3/1938 | Morrill |
| 2,111,148 | A | 3/1938 | Judelson |
| 2,134,493 | A | 10/1938 | Uroukoff |
| 2,188,506 | A | 1/1940 | Hall |
| 2,260,558 | A | 10/1941 | Caughey et al. |
| 2,267,158 | A | 12/1941 | Locke |
| 2,278,574 | A | 4/1942 | Spohr et al. |
| 2,287,795 | A | 6/1942 | Hall |
| 2,385,962 | A | 10/1945 | Barnett |
| 2,438,762 | A | 3/1948 | McLeckie |
| 2,452,858 | A | 11/1948 | Miller |
| 2,479,387 | A | 8/1949 | Matthews et al. |
| 2,504,740 | A | 4/1950 | Siegel |
| 2,550,118 | A | 4/1951 | Kauffman, II |
| 2,645,032 | A | 7/1953 | Hammell |
| 2,761,222 | A | 9/1956 | Bennett |
| 2,859,535 | A | 11/1958 | Carlson |
| 2,911,732 | A | 11/1959 | Webb |
| 3,009,188 | A | 11/1961 | Martin |
| 3,071,801 | A | 1/1963 | Scheiding |
| 3,091,955 | A | 6/1963 | Taylor et al. |
| 3,096,702 | A | 7/1963 | Malone, Sr. et al. |
| 3,180,239 | A | 4/1965 | Shearer et al. |
| 3,233,339 | A | 2/1966 | Long et al. |
| 3,258,853 | A | 7/1966 | Bradbury |
| 3,305,938 | A | 2/1967 | Arthur |
| 3,312,160 | A | 4/1967 | Rackley |
| 3,321,844 | A | 5/1967 | Seedorf |
| 3,375,593 | A | 4/1968 | Fleisher et al. |
| 3,383,700 | A | 5/1968 | Taylor |
| 3,409,995 | A | 11/1968 | Greenwood et al. |
| 3,437,030 | A | 4/1969 | Mastrosimone et al. |
| 3,448,497 | A | 6/1969 | Arnold et al. |
| 3,464,388 | A | 9/1969 | Stout |
| 3,526,946 | A | 9/1970 | Palmer |
| 3,587,177 | A | 6/1971 | Overly et al. |
| 3,603,002 | A | 9/1971 | Spierer |
| 3,610,881 | A | 10/1971 | Stewart |
| 3,612,824 | A | 10/1971 | Berryman |
| 3,643,346 | A | 2/1972 | Lester |
| 3,667,134 | A | 6/1972 | Rockson |
| 3,670,718 | A | 6/1972 | Brendgord |
| 3,721,026 | A | 3/1973 | McCallum |
| 3,744,149 | A | 7/1973 | Helbling |
| 3,748,746 | A | 7/1973 | Robandt |
| 3,752,059 | A | 8/1973 | Boyer |
| 3,758,799 | A | 9/1973 | Dochterman et al. |
| 3,766,397 | A | 10/1973 | Rockson |
| 3,785,523 | A | 1/1974 | Goldstein |
| 3,797,752 | A | 3/1974 | Cercone |
| 3,814,898 | A | 6/1974 | Levine |
| 3,826,607 | A | 7/1974 | Kuhn |
| 3,854,219 | A | 12/1974 | Staats |
| 3,874,073 | A | 4/1975 | Dochterman et al. |
| 3,952,867 | A | 4/1976 | McCord |
| 4,015,366 | A | 4/1977 | Hall, III |
| 4,039,774 | A | 8/1977 | Kata et al. |
| 4,047,692 | A | 9/1977 | Swin, Sr. |
| 4,085,522 | A | 4/1978 | Stroszynski |
| 4,087,925 | A | 5/1978 | Bienek |
| 4,091,762 | A | 5/1978 | Ruehl |
| 4,107,257 | A | 8/1978 | Swin, Sr. |
| 4,144,596 | A | 3/1979 | MacFarlane et al. |
| 4,145,769 | A | 3/1979 | MacFarlane et al. |
| 4,188,732 | A | 2/1980 | Quayle |
| 4,195,419 | A | 4/1980 | Quayle |
| 4,205,460 | A | 6/1980 | Taylor |
| 4,220,846 | A | 9/1980 | Rice et al. |
| 4,250,631 | A | 2/1981 | Moses |
| 4,267,643 | A | 5/1981 | Haried |
| 4,278,223 | A | 7/1981 | Fauteux |
| 4,295,233 | A | 10/1981 | Hinkel et al. |
| 4,310,747 | A | 1/1982 | Rice et al. |
| 4,312,139 | A | 1/1982 | Preisler et al. |
| 4,313,787 | A | 2/1982 | Ciboit et al. |
| 4,334,350 | A | 6/1982 | Rice et al. |
| RE31,023 | E | 9/1982 | Hall, III |
| 4,383,377 | A | 5/1983 | Crafton |
| 4,389,562 | A | 6/1983 | Chaudoir |
| 4,398,310 | A | 8/1983 | Lienhard |
| 4,489,507 | A | 12/1984 | Kawai |
| 4,495,086 | A | 1/1985 | Hiroshima et al. |
| 4,497,999 | A | 2/1985 | Postbeschild |
| 4,564,956 | A | 1/1986 | DiBuono |
| 4,600,128 | A | 7/1986 | Rohrer |
| 4,625,432 | A | 12/1986 | Baltes |
| 4,629,864 | A | 12/1986 | Wilson |
| 4,665,630 | A | 5/1987 | Postbeschild |
| 4,677,764 | A | 7/1987 | Cerny |
| 4,704,806 | A | 11/1987 | Gresens |
| 4,734,017 | A | 3/1988 | Levin |
| 4,754,607 | A | 7/1988 | Mackay |
| 4,802,287 | A | 2/1989 | Chen |
| 4,809,444 | A | 3/1989 | Henderson et al. |
| 4,826,262 | A | 5/1989 | Hartman et al. |
| 4,843,653 | A | 7/1989 | Coble |
| 4,857,705 | A | 8/1989 | Blevins |
| 4,876,435 | A | 10/1989 | Hawkins |
| 4,908,959 | A | 3/1990 | Kretchman et al. |
| 4,914,833 | A | 4/1990 | Pilolla et al. |
| 4,928,402 | A | 5/1990 | Allen |
| 4,941,521 | A | 7/1990 | Redekop et al. |
| 4,952,432 | A | 8/1990 | Ten Wolde |
| 4,986,681 | A | 1/1991 | Oliver |
| 4,991,314 | A | 2/1991 | Allen |
| 4,993,172 | A | 2/1991 | Allen |
| 5,031,337 | A | 7/1991 | Pilolla et al. |
| 5,047,351 | A | 9/1991 | Makiuchi et al. |
| 5,064,154 | A | 11/1991 | Payne |
| 5,074,322 | A | 12/1991 | Jaw |
| 5,107,603 | A | 4/1992 | Durazzani |
| 5,111,594 | A | 5/1992 | Allen |
| 5,146,695 | A | 9/1992 | Yang |
| 5,152,852 | A | 10/1992 | Hisamichi et al. |
| 5,168,621 | A | 12/1992 | Kruck et al. |
| 5,186,360 | A | 2/1993 | Mease et al. |
| 5,249,370 | A | 10/1993 | Stanger et al. |
| 5,253,373 | A | 10/1993 | Tsipov |
| 5,280,679 | A | 1/1994 | Edelman |
| 5,318,754 | A | 6/1994 | Collins et al. |
| 5,320,627 | A | 6/1994 | Sorensen et al. |
| 5,374,118 | A | 12/1994 | Kruck et al. |
| 5,377,427 | A | 1/1995 | Mashata |
| 5,379,483 | A | 1/1995 | Pino |
| 5,379,525 | A | 1/1995 | Raynor |
| 5,397,028 | A | 3/1995 | Jesadanont |
| 5,406,718 | A | 4/1995 | Stein |
| 5,407,354 | A | 4/1995 | Fife |
| 5,407,723 | A | 4/1995 | Curtin |
| 5,423,249 | A | 6/1995 | Meyer |
| 5,436,092 | A | 7/1995 | Ohtsuka et al. |
| 5,459,944 | A | 10/1995 | Tatsutani et al. |
| 5,522,411 | A | 6/1996 | Johnson |
| 5,545,451 | A | 8/1996 | Haung et al. |
| 5,546,678 | A | 8/1996 | Dhaemers |
| 5,555,640 | A | 9/1996 | Ou |
| 5,601,870 | A | 2/1997 | Haung et al. |
| 5,612,083 | A | 3/1997 | Haung et al. |
| 5,620,249 | A | 4/1997 | Musil |
| 5,636,815 | A | 6/1997 | Wilson |
| 5,755,040 | A | 5/1998 | Ou |
| 5,870,836 | A | 2/1999 | Grimes |
| 5,873,178 | A | 2/1999 | Johnson |
| 5,875,562 | A | 3/1999 | Fogarty |
| 5,882,743 | A | 3/1999 | McConnell |
| 5,901,462 | A | 5/1999 | Rudd |
| 5,945,068 | A | 8/1999 | Ferone |
| 5,972,474 | A | 10/1999 | Tsuzuki et al. |
| 5,974,685 | A | 11/1999 | Hironaka |
| 5,987,773 | A | 11/1999 | Lipscy |
| 6,005,227 | A | 12/1999 | Pappas |
| 6,018,885 | A | 2/2000 | Hill |
| 6,038,786 | A | 3/2000 | Aisenberg et al. |
| 6,047,485 | A | 4/2000 | Madyun |
| 6,050,000 | A | 4/2000 | Curzon |
| 6,050,275 | A | 4/2000 | Kamikawa et al. |
| 6,085,442 | A | 7/2000 | Erickson |

6,104,302 A 8/2000 Vuong
6,119,361 A 9/2000 Baker
6,119,437 A 9/2000 Baker
6,131,588 A 10/2000 Kamikawa et al.
6,137,067 A 10/2000 Helms et al.
6,158,673 A 12/2000 Toetschinger et al.
6,185,838 B1 2/2001 Moore
6,189,230 B1 2/2001 Huen
6,206,980 B1 3/2001 Robinson
6,256,903 B1 7/2001 Rudd
6,263,591 B1 7/2001 La Porte
6,279,836 B1 8/2001 Toetschinger et al.
6,280,092 B1 8/2001 Backus et al.
6,282,812 B1 9/2001 Wee et al.
6,295,410 B1 9/2001 Helms et al.
6,298,777 B1 10/2001 Dubois et al.
6,342,104 B1 1/2002 Kamikawa et al.
6,431,189 B1 8/2002 Deibert
6,431,217 B2 8/2002 Robinson
6,606,801 B2 8/2003 Strang et al.
6,620,504 B2 9/2003 Mizumura et al.
6,624,606 B2 9/2003 Kushida et al.
6,651,357 B2 11/2003 Bria et al.
6,681,497 B2 1/2004 Bria et al.
6,684,648 B2 2/2004 Faqih
6,705,107 B2 3/2004 Schlosser et al.
6,732,858 B1 5/2004 Chang Ou
6,746,543 B2 6/2004 Kamikawa et al.
6,749,148 B2 6/2004 Helfer-Grand
6,766,589 B1 7/2004 Bory et al.
6,769,197 B1 8/2004 Tai
6,793,851 B1 9/2004 Bompay et al.
6,845,569 B1 1/2005 Kim
6,860,032 B2 3/2005 Meyer
6,892,475 B2 5/2005 Wakamatsu et al.
6,914,341 B1 7/2005 McIntyre
6,956,498 B1 10/2005 Gauthier et al.
6,962,235 B2 11/2005 Leon
6,973,740 B2 12/2005 Meyer
7,036,242 B2 5/2006 Komulainen et al.
7,036,575 B1 5/2006 Rodney et al.
7,039,301 B1 5/2006 Aisenberg et al.
7,040,021 B2 5/2006 Talavera
7,042,714 B2 5/2006 Hillman et al.
7,055,262 B2 6/2006 Goldberg et al.
7,087,117 B2 8/2006 Katsuoka et al.
7,150,890 B2 12/2006 Rosales et al.
7,182,820 B2 2/2007 Campbell et al.
7,284,391 B2 10/2007 Miller et al.
7,309,376 B2 12/2007 Barre et al.
7,316,080 B1 1/2008 Woolsey
7,380,348 B2 6/2008 Seebach
7,437,833 B2 10/2008 Sato et al.
7,442,257 B2 10/2008 Katsuoka et al.
7,506,458 B2 3/2009 Lee et al.
7,509,998 B1 3/2009 Rodney
7,526,833 B2 5/2009 Cochran et al.
7,555,209 B2 6/2009 Pradas Diez et al.
7,562,543 B2 7/2009 Kendall et al.
7,575,636 B2 8/2009 Katsuoka et al.
7,587,917 B2 9/2009 Gilboe et al.
7,596,883 B2 10/2009 Kameishi
7,597,122 B1 10/2009 Smith
7,614,160 B2 11/2009 Kameishi et al.
7,617,702 B2 11/2009 Sunshine et al.
7,624,600 B2 12/2009 Sunshine et al.
7,628,043 B2 12/2009 Sunshine et al.
7,640,678 B2 1/2010 Lee et al.
7,653,963 B2 2/2010 Cochran et al.
7,665,225 B2 2/2010 Goldberg et al.
7,802,340 B2 9/2010 Knopow et al.
7,832,697 B2 11/2010 West et al.
7,856,736 B2 12/2010 Churchill et al.
7,946,055 B2 5/2011 Churchill et al.
2001/0000576 A1 5/2001 Robinson
2001/0027795 A1 10/2001 Cain-Kozma et al.
2002/0004994 A1 1/2002 Rudd
2002/0046569 A1 4/2002 Faqih
2002/0078705 A1 6/2002 Schlosser et al.
2002/0092198 A1 7/2002 Bria et al.
2002/0132214 A1 9/2002 Mattson et al.
2002/0185987 A1 12/2002 Kushida et al.
2002/0198662 A1 12/2002 Chen
2003/0000036 A1 1/2003 Fan
2003/0001468 A1 1/2003 Hase et al.
2003/0066281 A1 4/2003 Mizumura et al.
2003/0071075 A1 4/2003 Frankenbach et al.
2003/0074718 A1 4/2003 English
2003/0159718 A1 8/2003 Kamikawa et al.
2003/0172547 A1 9/2003 Shepard, II
2003/0188448 A1 10/2003 Reed
2004/0031119 A1 2/2004 McKay
2004/0045168 A1 3/2004 Talavera
2004/0049940 A1 3/2004 Komulainen et al.
2004/0088817 A1 5/2004 Cochran et al.
2004/0090040 A1 5/2004 Pearson
2004/0108281 A1 6/2004 Gerteis et al.
2004/0111817 A1 6/2004 Chen et al.
2004/0168342 A1 9/2004 Wakamatsu et al.
2004/0226312 A1 11/2004 Miller et al.
2004/0244090 A1 12/2004 Langer
2004/0255484 A1 12/2004 Storrer et al.
2005/0036283 A1 2/2005 Hillman et al.
2005/0066538 A1 3/2005 Goldberg et al.
2005/0072358 A1 4/2005 Katsuoka et al.
2005/0076529 A1 4/2005 Holmes
2005/0076662 A1 4/2005 Roche et al.
2005/0100436 A1 5/2005 Egusquiza
2005/0120508 A1 6/2005 Morgan et al.
2005/0153002 A1 7/2005 Socla Rosales et al.
2005/0211357 A1 9/2005 Ren
2005/0258114 A1 11/2005 Davis
2005/0262720 A1 12/2005 Rane et al.
2005/0273969 A1 12/2005 Watson et al.
2006/0000110 A1 1/2006 Aisenberg et al.
2006/0036198 A1 2/2006 Cafaro et al.
2006/0060082 A1 3/2006 Barre et al.
2006/0096118 A1 5/2006 Ward, III et al.
2006/0171660 A1 8/2006 Hsu
2006/0179676 A1 8/2006 Goldberg et al.
2006/0180596 A1 8/2006 Young et al.
2006/0191901 A1 8/2006 Taylor et al.
2006/0201015 A1 9/2006 Russell
2006/0201018 A1 9/2006 McKay et al.
2006/0206233 A1 9/2006 Carpenter et al.
2006/0230630 A1 10/2006 Lee et al.
2006/0236929 A1 10/2006 Katsuoka et al.
2006/0243204 A1 11/2006 Katsuoka et al.
2006/0243205 A1 11/2006 Katsuoka et al.
2006/0272120 A1 12/2006 Barrick et al.
2006/0272170 A1 12/2006 Holmes
2006/0288508 A1 12/2006 Knopow et al.
2007/0033937 A1 2/2007 Baur et al.
2007/0079524 A1 4/2007 Sato et al.
2007/0094884 A1 5/2007 Micheludis
2007/0113369 A1 5/2007 Cochran et al.
2007/0144034 A1 6/2007 Kameishi
2007/0160515 A1 7/2007 Mohrman
2007/0163141 A1 7/2007 Hsu
2007/0263994 A1 11/2007 Diez et al.
2007/0274822 A1 11/2007 Liu et al.
2007/0290110 A1 12/2007 West et al.
2008/0004963 A1 1/2008 Montalbano et al.
2008/0022551 A1 1/2008 Banta et al.
2008/0032066 A1 2/2008 Stiblert et al.
2008/0052952 A1 3/2008 Nelson
2008/0127830 A1 6/2008 Le et al.
2008/0209760 A1 9/2008 French et al.
2008/0216342 A1 9/2008 Kameishi et al.
2008/0216343 A1 9/2008 Churchill et al.
2008/0216344 A1 9/2008 Churchill et al.
2008/0222910 A1 9/2008 Churchill et al.
2008/0253754 A1 10/2008 Rubin
2008/0256825 A1 10/2008 Hsu
2008/0259566 A1 10/2008 Fried
2008/0263889 A1 10/2008 Fukaya et al.
2008/0272734 A1 11/2008 Ren
2008/0301970 A1 12/2008 Hackwell et al.

| | | | |
|---|---|---|---|
| 2008/0313918 | A1 | 12/2008 | Dyson et al. |
| 2008/0313919 | A1 | 12/2008 | Churchill et al. |
| 2008/0317448 | A1 | 12/2008 | Brown et al. |
| 2009/0000142 | A1 | 1/2009 | Churchill et al. |
| 2009/0004962 | A1 | 1/2009 | Collins |
| 2009/0044420 | A1 | 2/2009 | Hsu |
| 2009/0071030 | A1 | 3/2009 | Myung et al. |
| 2009/0077736 | A1 | 3/2009 | Loberger et al. |
| 2009/0113746 | A1 | 5/2009 | Churchill et al. |
| 2009/0113748 | A1 | 5/2009 | Dyson et al. |
| 2009/0119942 | A1 | 5/2009 | Aisenberg et al. |
| 2009/0130745 | A1 | 5/2009 | Williams et al. |
| 2009/0195877 | A1 | 8/2009 | Nakai |
| 2009/0221059 | A1 | 9/2009 | Williams et al. |
| 2009/0236629 | A1 | 9/2009 | Nishikawa et al. |
| 2009/0255142 | A1 | 10/2009 | Brown |
| 2009/0293304 | A1 | 12/2009 | Yang |
| 2009/0320316 | A1 | 12/2009 | Zakai |
| 2010/0005614 | A1 | 1/2010 | Cochran et al. |
| 2010/0024244 | A1 | 2/2010 | Potter |
| 2010/0052408 | A1 | 3/2010 | Ren |
| 2010/0119755 | A1 | 5/2010 | Chung et al. |
| 2010/0130686 | A1 | 5/2010 | Oshima |
| 2010/0154239 | A1 | 6/2010 | Hutchinson |
| 2010/0154863 | A1 | 6/2010 | Bennett et al. |
| 2010/0192399 | A1 | 8/2010 | Sawabe et al. |
| 2010/0209080 | A1 | 8/2010 | Rubin et al. |
| 2010/0210745 | A1 | 8/2010 | McDaniel et al. |
| 2010/0212177 | A1 | 8/2010 | Chen |
| 2010/0227963 | A1 | 9/2010 | Hironaka et al. |
| 2011/0082021 | A1 | 4/2011 | Burns |
| 2011/0099834 | A1 | 5/2011 | Brown |
| 2011/0131829 | A1 | 6/2011 | Zagar et al. |

FOREIGN PATENT DOCUMENTS

| | | |
|---|---|---|
| CA | 1124057 | 5/1982 |
| CH | 645277 | 9/1984 |
| CH | 658372 | 11/1986 |
| CH | 669116 | 2/1989 |
| CZ | 15 805 | 11/2005 |
| DE | 548 998 | 4/1932 |
| DE | 26 57 164 | 6/1978 |
| DE | 3116285 | 2/1983 |
| DE | 3204258 | 8/1983 |
| DE | 3218578 | 11/1983 |
| DE | 3440412 | 3/1986 |
| DE | 3530888 | 3/1986 |
| DE | 3443438 | 5/1986 |
| DE | 3443439 | 5/1986 |
| DE | 3508316 | 9/1986 |
| DE | 3513159 | 10/1986 |
| DE | 3527835 | 2/1987 |
| DE | 3529410 | 2/1987 |
| DE | 3735197 | 5/1989 |
| DE | 3814489 | 11/1989 |
| DE | 4022003 | 1/1992 |
| DE | 4107439 | 9/1992 |
| DE | 4107489 | 9/1992 |
| DE | 4218658 | 12/1992 |
| DE | 4208680 | 9/1993 |
| DE | 4428978 | 3/1995 |
| DE | 196 12 923 | 10/1997 |
| DE | 19654756 | 7/1998 |
| DE | 10109237 | 9/2002 |
| DE | 101 14 473 | 10/2002 |
| DE | 10147778 | 4/2003 |
| DE | 10157975 | 6/2003 |
| EP | 0 059 888 | 9/1982 |
| EP | 0 068 491 | 1/1983 |
| EP | 0 211 418 | 2/1987 |
| EP | 251898 | 1/1988 |
| EP | 329171 | 8/1989 |
| EP | 0 357 305 | 3/1990 |
| EP | 382521 | 8/1990 |
| EP | 393254 | 10/1990 |
| EP | 0 438 208 | 7/1991 |
| EP | 0567678 | 11/1993 |
| EP | 0574160 | 12/1993 |
| EP | 0 589 568 | 3/1994 |
| EP | 0644334 | 3/1995 |
| EP | 0679358 | 11/1995 |
| EP | 832697 | 4/1998 |
| EP | 855736 | 7/1998 |
| EP | 976356 | 2/2000 |
| EP | 1166704 | 1/2002 |
| EP | 1250878 | 10/2002 |
| EP | 1250879 | 10/2002 |
| FR | 2 537 425 | 6/1984 |
| FR | 2543592 | 10/1984 |
| FR | 2569029 | 2/1986 |
| FR | 2577109 | 8/1986 |
| FR | 2582196 | 11/1986 |
| FR | 2588741 | 4/1987 |
| FR | 2595455 | 9/1987 |
| FR | 2 597 717 | 10/1987 |
| FR | 2790979 | 9/2000 |
| GB | 680148 | 3/1950 |
| GB | 1024671 | 3/1966 |
| GB | 2 012 362 | 7/1979 |
| GB | 2050609 | 1/1981 |
| GB | 2054151 | 2/1981 |
| GB | 2057528 | 4/1981 |
| GB | 2085725 | 5/1982 |
| GB | 2112639 | 7/1983 |
| GB | 2116034 | 9/1983 |
| GB | 2 136 291 | 9/1984 |
| GB | 2137878 | 10/1984 |
| GB | 2142128 | 1/1985 |
| GB | 2144325 | 3/1985 |
| GB | 2147804 | 5/1985 |
| GB | 2 179 856 | 3/1987 |
| GB | 2 189 382 | 10/1987 |
| GB | 2196843 | 5/1988 |
| GB | 2198229 | 6/1988 |
| GB | 2236248 | 4/1991 |
| GB | 2 249 026 | 4/1992 |
| GB | 2 253 035 | 8/1992 |
| GB | 2 434 094 | 7/2007 |
| JP | 59-200143 | 11/1984 |
| JP | 61-021393 | 2/1986 |
| JP | 63-154138 | 6/1988 |
| JP | 63-279033 | 11/1988 |
| JP | 2-52973 | 2/1990 |
| JP | 3-82419 | 4/1991 |
| JP | 3-82420 | 4/1991 |
| JP | 4-73026 | 3/1992 |
| JP | 5-49553 | 3/1993 |
| JP | 6-62979 | 3/1994 |
| JP | 6-63909 | 3/1994 |
| JP | 6-209879 | 8/1994 |
| JP | 7-79880 | 3/1995 |
| JP | 7-116076 | 5/1995 |
| JP | 7-280419 | 10/1995 |
| JP | 7-308266 | 11/1995 |
| JP | 8-187209 | 7/1996 |
| JP | 8-196798 | 8/1996 |
| JP | 8-318176 | 12/1996 |
| JP | 9-66003 | 3/1997 |
| JP | 9-135789 | 5/1997 |
| JP | 10-113304 | 5/1998 |
| JP | 10-248748 | 9/1998 |
| JP | 10-281627 | 10/1998 |
| JP | 11-18999 | 1/1999 |
| JP | 11-56673 | 3/1999 |
| JP | 11-70058 | 3/1999 |
| JP | 11-178742 | 7/1999 |
| JP | 11-244191 | 9/1999 |
| JP | 2000-178 | 1/2000 |
| JP | 2000-157447 | 6/2000 |
| JP | 2000-157448 | 6/2000 |
| JP | 2000-245653 | 9/2000 |
| JP | 2000-300465 | 10/2000 |
| JP | 2000-316747 | 11/2000 |
| JP | 2001-157647 | 6/2001 |
| JP | 2001-275898 | 10/2001 |
| JP | 2001-346715 | 12/2001 |
| JP | 2002-034835 | 2/2002 |
| JP | 2002-34843 | 2/2002 |

| | | |
|---|---|---|
| JP | 2002-34844 | 2/2002 |
| JP | 2002-34845 | 2/2002 |
| JP | 2002-34852 | 2/2002 |
| JP | 2002-136448 | 5/2002 |
| JP | 2002-306370 | 10/2002 |
| JP | 2002-345681 | 12/2002 |
| JP | 2003-180554 | 7/2003 |
| JP | 2003-275129 | 9/2003 |
| JP | 2004-97840 | 4/2004 |
| JP | 2004-105511 | 4/2004 |
| JP | 2004-113615 | 4/2004 |
| JP | 2004-113712 | 4/2004 |
| JP | 2004-231935 | 8/2004 |
| JP | 2004-305287 | 11/2004 |
| JP | 2004-357820 | 12/2004 |
| JP | 2005-27693 | 2/2005 |
| JP | 2005-160874 | 6/2005 |
| JP | 2005-168799 | 6/2005 |
| JP | 2005-177415 | 7/2005 |
| JP | 2005-291274 | 10/2005 |
| JP | 2006-187397 | 7/2006 |
| WO | WO-85/03462 | 8/1985 |
| WO | WO-85/04184 | 9/1985 |
| WO | WO-86/06693 | 11/1986 |
| WO | WO-87/07040 | 11/1987 |
| WO | WO 97/34708 | 9/1997 |
| WO | WO-98/26703 | 6/1998 |
| WO | WO-98/53752 | 12/1998 |
| WO | WO-99/53250 | 10/1999 |
| WO | WO-01/25705 | 4/2001 |
| WO | WO-03/024291 | 3/2003 |
| WO | WO-2004/100743 | 11/2004 |
| WO | WO 2005/029687 | 3/2005 |
| WO | WO-2005/074776 | 8/2005 |
| WO | WO-2007/015039 | 2/2007 |
| WO | WO 2007/015040 | 2/2007 |
| WO | WO-2007/015042 | 2/2007 |
| WO | WO-2007/015044 | 2/2007 |
| WO | WO 2007/015045 | 2/2007 |

OTHER PUBLICATIONS

International Search Report mailed Mar. 16, 2007, directed at counterpart international application No. PCT/GB2007/000089; 5 pages.
GB Search Report dated Aug. 25, 2006, directed to GB Application No. GB0600881.7; 1 page.
GB Search Report dated Oct. 28, 2005, directed to GB Application No. GB0515744.1; 1 page.
International Search Report mailed Aug. 7, 2006, directed to International Application No. PCT/GB2006/002138; 1 page.
GB Search Report dated Oct. 27, 2005, directed to GB Application No. GB0515752.4; 1 page.
GB Search Report dated Nov. 24, 2005, directed to GB Application No. GB0515752.4; 1 page.
International Search Report dated Jul. 17, 2006, directed to International Application No. PCT/GB2006/002139; 1 page.
GB Search Report dated Oct. 27, 2005, directed to GB Application No. GB0515749.0; 1 page.
International Search Report dated Aug. 25, 2006, directed to International Application No. PCT/GB2006/002199; 2 pages.
International Search Report and Written Opinion dated Aug. 25, 2006, directed to International Application No. PCT/GB2006/002084; 14 pages.
GB Search Report dated Nov. 18, 2005, directed to GB Application No. GB0515754.0; 1 page.
Churchill et al., U.S. Office Action mailed Apr. 1, 2010, directed to U.S. Appl. No. 11/997,301; 10 pages.
Churchill et al., U.S. Office Action mailed Apr. 1, 2010, directed to U.S. Appl. No. 11/997,303; 9 pages.
Churchill et al., U.S. Office Action mailed Aug. 17, 2010, directed to U.S. Appl. No. 11/997,303; 7 pages.
Churchill et al., U.S. Office Action mailed Oct. 22, 2010, directed to U.S. Appl. No. 11/997,301; 15 pages.
French et al., U.S. Office Action mailed Aug. 11, 2011, directed to U.S. Appl. No. 11/997,309; 8 pages.
Dyson et al., U.S. Office Action mailed Jul. 22, 2011, directed to U.S. Appl. No. 11/997,302; 14 pages.
Dyson et al., U.S. Office Action mailed Aug. 8, 2011, directed to U.S. Appl. No. 11/997,308; 8 pages.
Hutchinson, U.S. Office Action mailed Jun. 24, 2010, directed to U.S. Appl. No. 12/160,961; 8 pages.
Hutchinson, U.S. Office Action mailed Dec. 9, 2010, directed to U.S. Appl. No. 12/160,961; 10 pages.
Churchill et al., U.S. Office Action mailed Aug. 12, 2011, directed to U.S. Appl. No. 11/997,311; 7 pages.
Hackwell et al., U.S. Office Action mailed Apr. 4, 2011, directed to U.S. Appl. No. 11/997,305; 7 pages.
Hackwell et al., U.S. Office Action mailed Oct. 17, 2011, directed to U.S. Appl. No. 11/997,305; 7 pages.
French et al., U.S. Office Action mailed Jan. 20, 2012, directed to U.S. Appl. No. 11/997,309; 7 pages.
Dyson et al., U.S. Office Action mailed Jan. 18, 2012, directed to U.S. Appl. No. 11/997,308; 7 pages.
Churchill et al., U.S. Office Action mailed Sep. 28, 2011, directed to U.S. Appl. No. 11/997,310; 7 pages.

DRYING APPARATUS

REFERENCE TO RELATED APPLICATIONS

This application is a national stage application under 35 USC 371 of International Application No. PCT/GB2007/000089, filed Jan. 12, 2007, which claims the priority of United Kingdom Application No. 0600534.2, filed Jan. 12, 2006, the contents of both of which prior applications are incorporated herein by reference.

FIELD OF THE INVENTION

The invention relates to drying apparatus which makes use of a narrow jet of high velocity, high pressure air to dry an object, including part of the human body. Particularly, but not exclusively, the invention relates to a hand dryer in which the air jet is emitted through a slot-like opening in the casing of the hand dryer.

BACKGROUND OF THE INVENTION

The use of air jets to dry hands is well known. Examples of hand dryers which emit at least one air jet through a slot-like opening are shown in GB 2249026A, JP 2002-034835A and JP 2002306370A. However, in practice it is very difficult to achieve an evenly distributed airflow of sufficiently high momentum to dry the user's hands efficiently in an acceptably short length of time. Furthermore, the amount of noise emitted by a motor suitable for generating an airflow of sufficiently high momentum adequately to dry the user's hands can be unacceptably high.

One way of reducing the amount of motor noise emitted by the drying apparatus is disclosed in our copending application no GB 0515754.0. In this arrangement, vanes are positioned in the ducts which carry the airflow from the motor to the slot-like openings. A further prior art arrangement is shown in JP 2003-180554, in which various box-like silencing members are positioned inside the casing of the hand dryer.

SUMMARY OF THE INVENTION

It is an object of the invention to provide drying apparatus in which an airflow of sufficient momentum efficiently to dry the user's hands is produced and in which the noise emitted by the motor is further improved in comparison to prior art and known devices. It is a further object of the present invention to provide drying apparatus in which the noise emitted by the apparatus is comparatively low.

The invention provides drying apparatus having a casing, a cavity formed in the casing for receiving an object, a fan located in the casing and capable of creating an airflow, a motor provided in the casing for driving the fan and ducting for carrying the airflow from the fan to at least one opening arranged to emit the airflow into the cavity, wherein the ducting comprises at least one air duct having a wall in which perforations are provided, and a layer of sound-absorbing material is located on the external surface of the wall so as to cover the perforations.

The provision of a sound-absorbing material on the outside of the perforated wall reduces the volume of aero-acoustic noise emitted by the apparatus which, in the case of a hand dryer, renders the hand dryer more comfortable to use.

Preferably, the perforations in the wall are elongate and extend generally in the direction of the airflow along the air duct. More preferably, the length of each perforation is significantly larger than the width thereof. Such an arrangement provides the wall with a significant area of perforation without significantly affecting the structural strength of the wall.

In one preferred embodiment, the air duct has two opposing walls with perforations being provided in each wall and the perforations are substantially aligned with one another.

In a preferred embodiment, the sound-absorbing material is compressed between the wall and an outer casing, and in a still further preferred embodiment, the sound-absorbing material is a polyester-based foam.

BRIEF DESCRIPTION OF THE DRAWINGS

Embodiments of the invention, both in the form of a hand dryer, will now be described with reference to the accompanying drawings, in which.

DETAILED DESCRIPTION OF THE INVENTION

Figure 2:
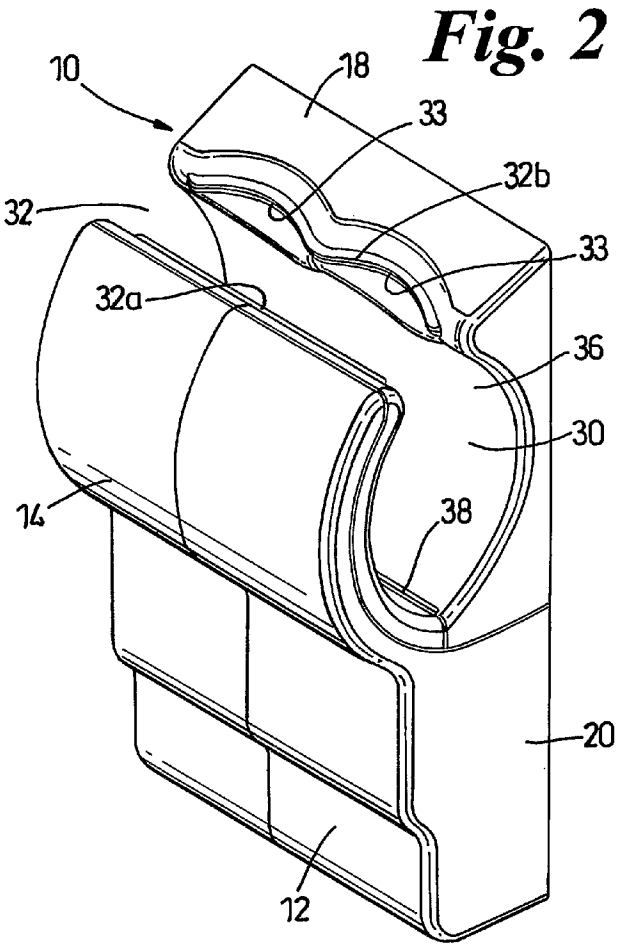
FIG. 2 is a perspective view of the hand dryer of FIG. 1.
Figure 1:
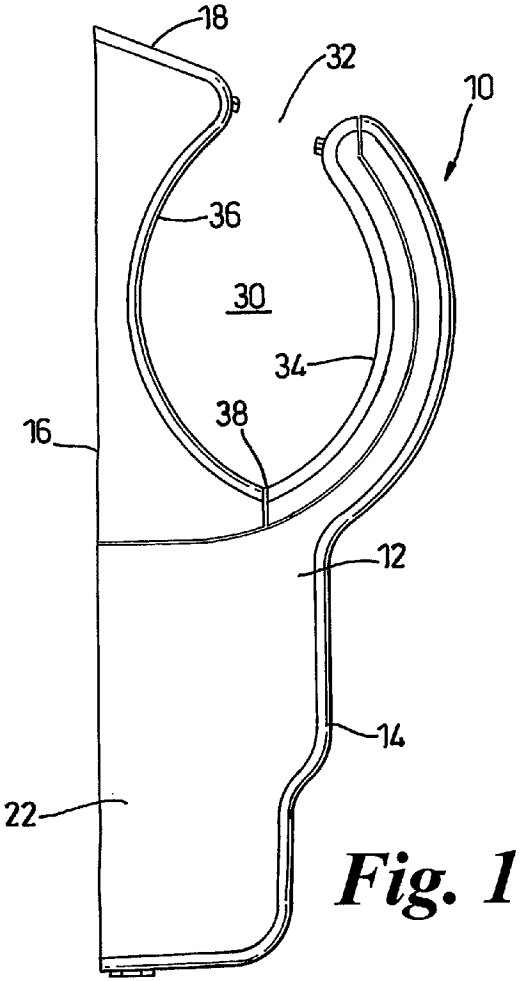
FIG. 1 is a side view of drying apparatus according to the invention in the form of a hand dryer.

Referring firstly to FIGS. 1 and 2, the hand dryer 10 shown in the drawings comprises an outer casing 12 having a front wall 14, a rear wall 16, an upper face 18 and side walls 20, 22. The rear wall 16 can incorporate fixing devices (not shown) for securing the hand dryer 10 to a wall or other structure prior to use. An electrical connection (not shown) is also provided on the rear wall or elsewhere on the casing 12. A cavity 30 is formed in the upper part of the casing 12 as can be seen from FIGS. 1 and 2. The cavity 30 is open at its upper end and delimited thereat by the top of the front wall 14 and the front of the upper face 18. The space between the top of the front wall 14 and the front of the upper face 18 forms a cavity entrance 32 which is sufficiently wide to allow a user's hands to be introduced to the cavity 30 through the cavity entrance 32. The cavity 30 is also open to the sides of the hand dryer 10 by appropriate shaping of the side walls 20, 22.

The cavity 30 has a front wall 34 and a rear wall 36 which delimit the cavity 30 to the front and rear respectively. Located in the lowermost end of the cavity 30 is a drain 38 which communicates with a reservoir (not shown) located in the lower part of the casing 12. The purpose of the drain and reservoir will be described below.

Figure 3:
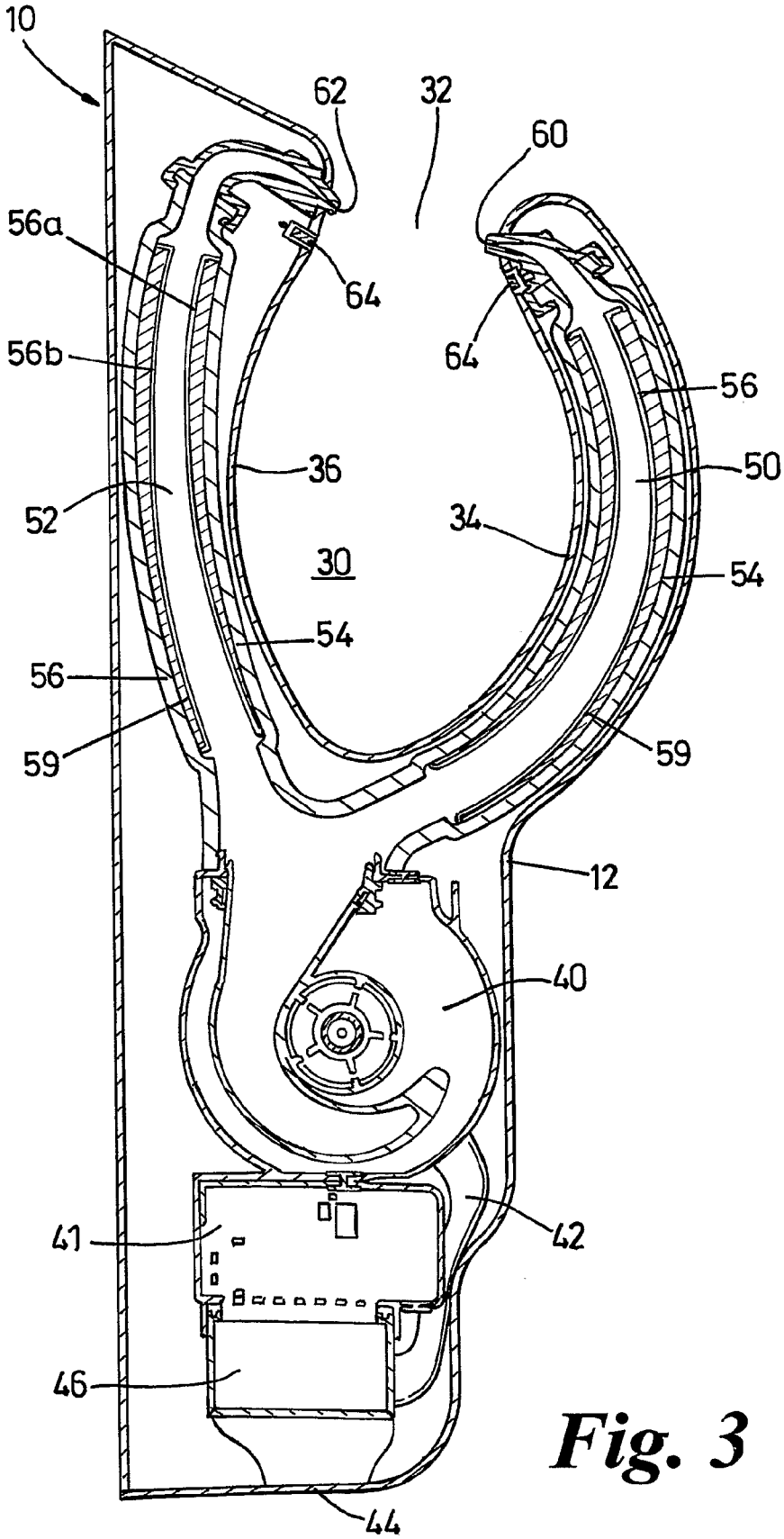
FIG. 3 is a side sectional view of the hand dryer of FIG. 1.

As shown in FIG. 3, a motor (not shown) is located inside the casing 12 and a fan 40, which is driven by the motor, is also located inside the casing 12. The motor is connected to the electrical connection and is controlled by a controller 41. The inlet 42 of the fan 40 communicates with an air inlet 44 formed in the casing 12. A filter 46 is located in the air passageway connecting the air inlet 44 to the fan inlet 42 so as to prevent the ingress of any debris which might cause damage to the motor or the fan 40. The outlet of the fan 40 communicates with a pair of air ducts 50, 52 which are located inside the casing 12. The front air duct 50 is located primarily between the front wall 14 of the casing 12 and the front wall 34 of the cavity 30, and the rear air duct 52 is located primarily between the rear wall 16 of the casing 12 and the rear wall 36 of the cavity 30.

Figure 4:
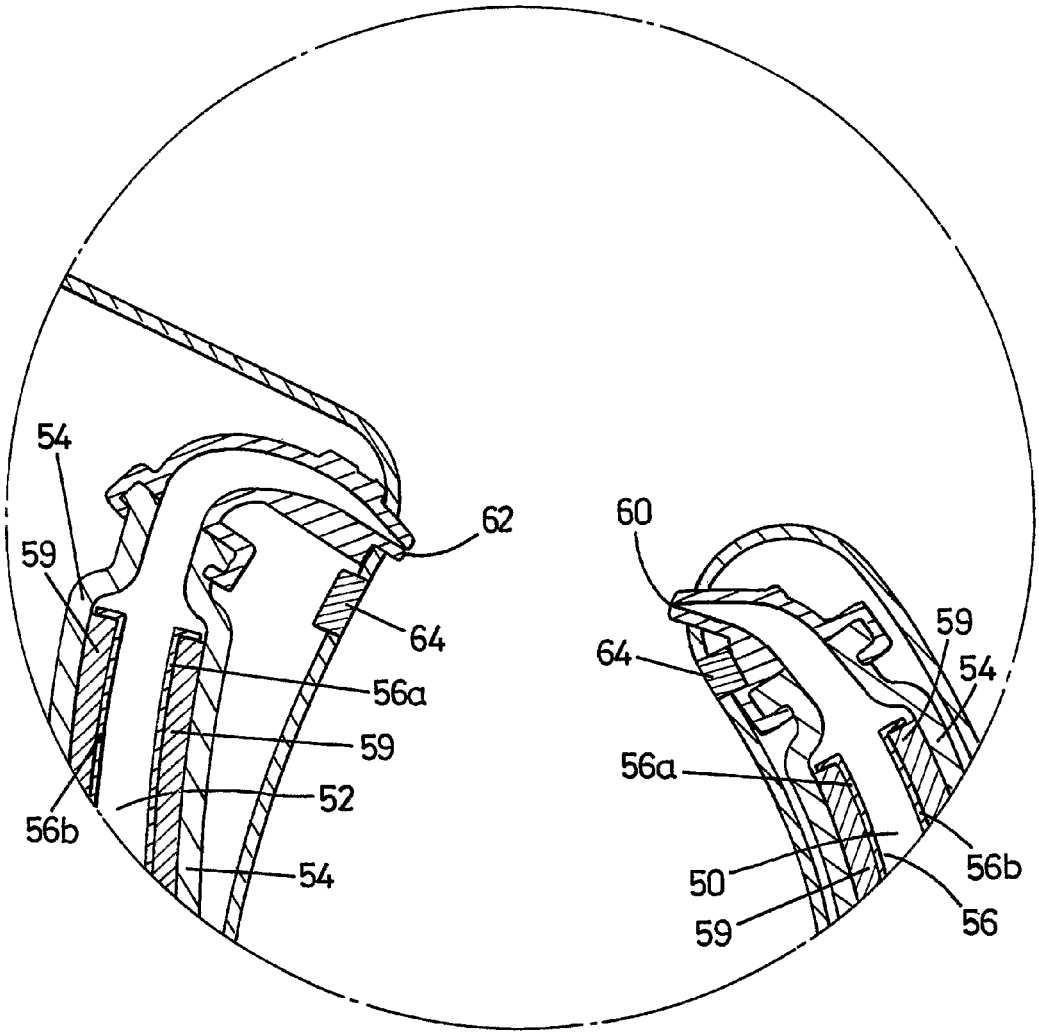
FIG. 4 is a side sectional view, shown on an enlarged scale, of the upper ends of the air ducts forming part of the hand dryer of FIG. 1.

The air ducts 50, 52 are arranged to conduct air from the fan 40 to a pair of opposed slot-like openings 60, 62 which are located in the front and rear walls 34, 36 respectively of the cavity 30. Further details of the air ducts 50, 52 will be described below. The slot-like openings 60, 62 are arranged at the upper end of the cavity 30 in the vicinity of the cavity entrance 32. The slot-like openings 60, 62 are each configured so as to direct an airflow generally across the cavity entrance 32 towards the opposite wall of the cavity 30. The slot-like openings 60, 62 are offset in the vertical direction and angled towards the lowermost end of the cavity 30. FIG. 4 shows the upper ends of the air ducts 50, 52 and the slot-like openings 60, 62 in greater detail.

Sensors 64 are positioned in the front and rear walls 34, 36 of the cavity 30 immediately below the slot-like openings 60, 62. These sensors 64 detect the presence of a user's hands which are inserted into the cavity 30 via the cavity entrance 32 and are arranged to send a signal to the motor when a user's hands are introduced to the cavity 30. As can be seen from FIGS. 1 and 3, the downstream ends of the ducts 50, 52 project slightly beyond the surface of the front and rear walls 34, 36 of the cavity 30. This reduces the tendency of the user's hands to be sucked towards one or other of the walls 34, 36 of the cavity, which enhances the ease with which the hand dryer 10 can be used. The positioning of the sensors 64 immediately below the inwardly projecting ducts 50, 52 also reduces the risk of the sensors 64 becoming dirty and inoperative.

As can be seen from FIG. 2, the shape of the cavity entrance 32 is such that the front edge 32*a* is generally straight and extends laterally across the width of the hand dryer 10. However, the rear edge 32*b* has a shape which consists of two curved portions 33 which generally follow the shape of the backs of a pair of human hands as they are inserted downwardly into the cavity 30 through the cavity entrance 32. The rear edge 32*b* of the cavity entrance 32 is substantially symmetrical about the centre line of the hand dryer 10. The intention of the shaping and dimensioning of the front and rear edges 32*a*, 32*b* of the cavity entrance 32 is that, when a user's hands are inserted into the cavity 30 through the cavity entrance 32, the distance from any point on the user's hands to the nearest slot-like opening is substantially uniform.

Figure 5:
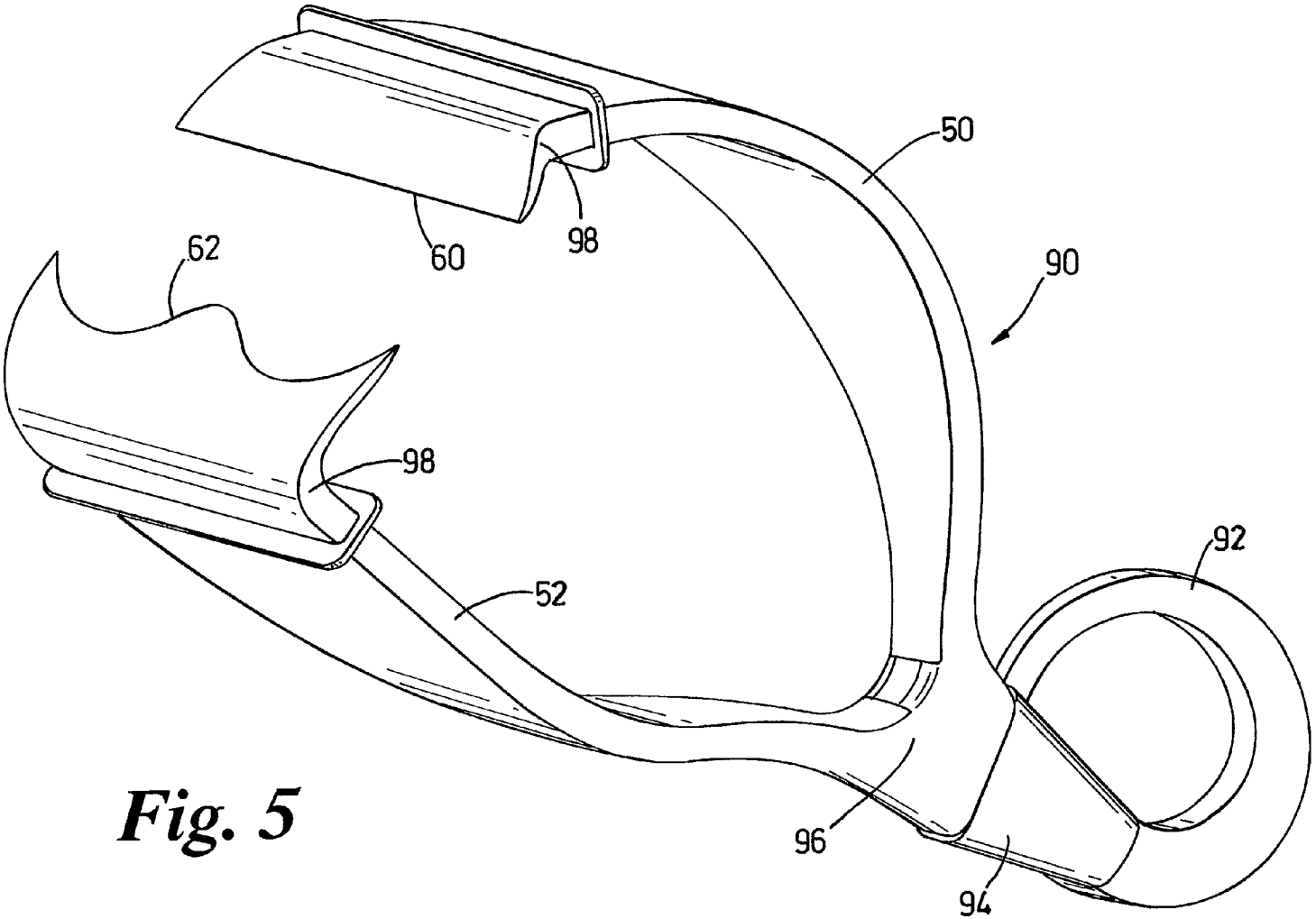
FIG. 5 is an isometric view of the ducting forming part of the hand dryer of FIG. 1 shown in isolation from the other components of the apparatus.

The air ducts 50, 52 form part of the ducting 90 which lies between the fan 40 and the slot-like openings 60, 62. A perspective view of the ducting 90 is shown in FIG. 5. The ducting 90 includes a scroll 92 which lies adjacent the fan 40 and receives the airflow generated by the fan 40. The scroll 92 communicates with a first chamber 94 which is generally square in cross-section, although the cross-section could easily be generally circular. The intention is that the cross-section of the chamber 94 should have dimensions which are substantially the same in both directions. Immediately downstream of the chamber 94 is a Y-junction 96 downstream of which the air ducts 50, 52 are located. As has been described above, the air ducts 50, 52 pass towards the upper end of the casing 12 with the front air duct 50 being located between the front wall 14 of the casing 12 and the front wall 34 of the cavity 30 and the rear duct 52 being located between the rear wall 16 of the casing 12 and the rear wall 36 of the cavity 30. The air ducts 50, 52 communicate with the slot-like openings 60, 62 at the upper end of the cavity 30.

The ducting 90 is designed so that the cross-sectional area of the ducting 90 gradually transforms from the generally square (or circular) shape of the chamber 94 to the slot-like shape of the openings in a smooth and gradual manner. Immediately downstream of the chamber 94, the ducting divides into the air ducts 50, 52, at the upstream end of which the cross-sectional area is still generally square in shape—ie, the breadth and depth of the cross-section are substantially similar. However, the cross-section changes gradually with distance from the chamber 94 so that the breadth of each duct 50, 52 increases as the depth reduces. All of the changes are smooth and gradual to minimise any frictional losses.

At a point 98 immediately upstream of each of the slot-like openings 60, 62, the cross-sectional area of each of the air ducts 60, 62 begins to decrease so as to cause the velocity of the airflow travelling towards the slot-like openings 60, 62 to increase dramatically. However, between the chamber 94 and the point 98 in each air duct 50, 52, the total cross-sectional area of the ducting (ie. the combined cross-sectional area of the air ducts 50 and 52) remains substantially constant.

Figure 6:
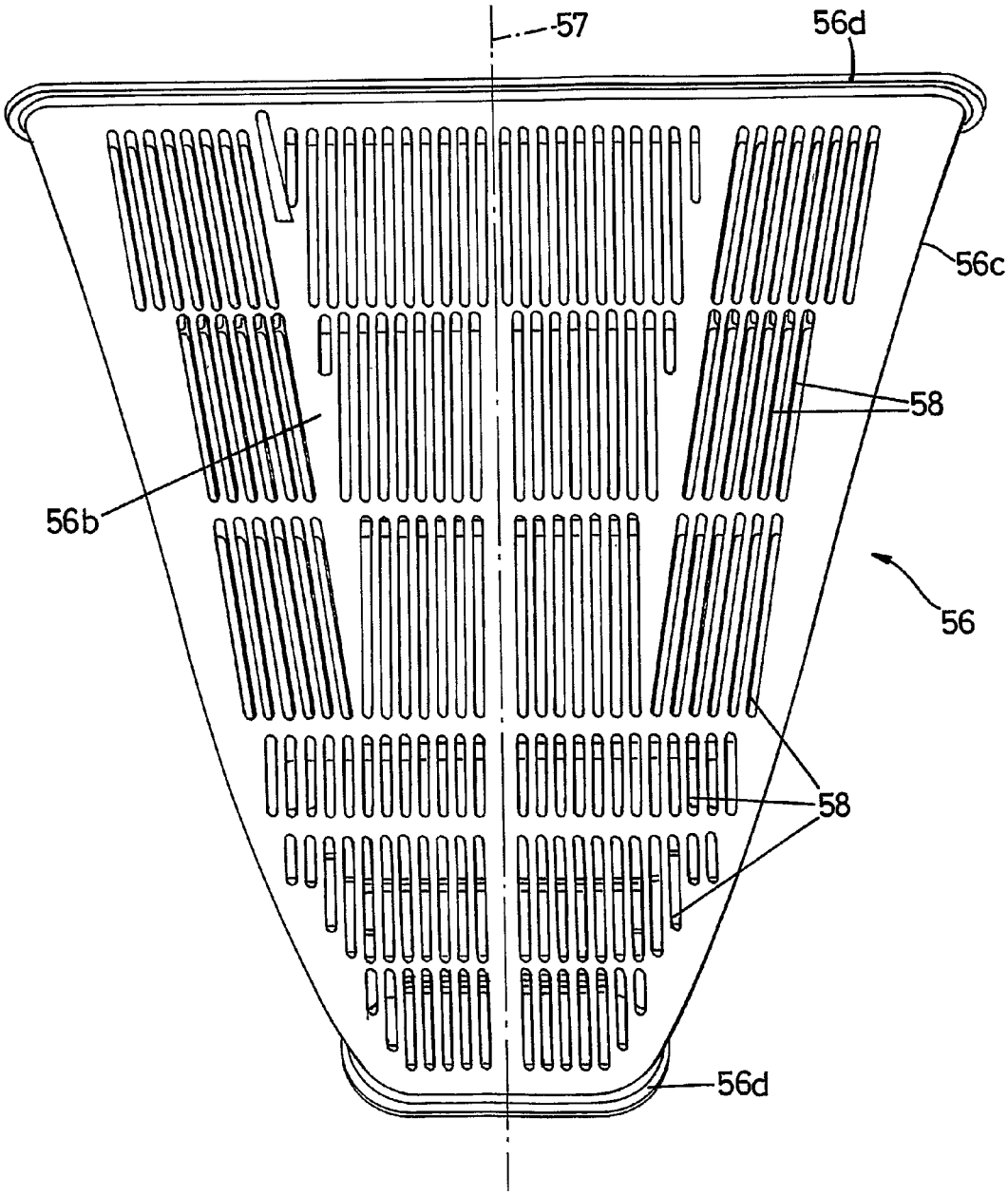
FIG. 6 is a front view of one of the walls forming part of the ducting of FIG. 5.
Figure 7:
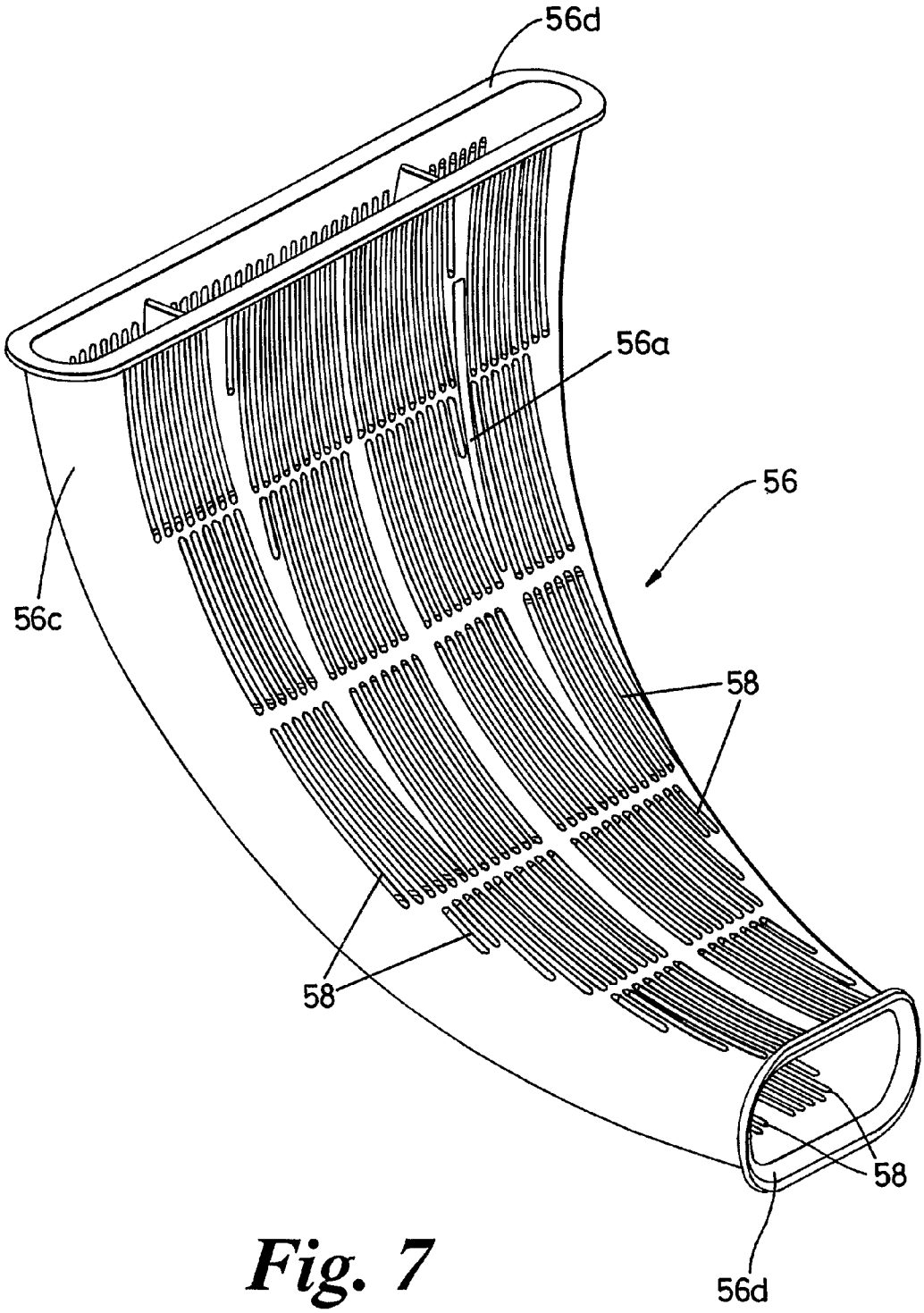
FIG. 7 is a perspective view of a pair of opposing walls forming part of the ducting of FIG. 5.

The internal features of the air ducts 50, 52 will now be described in greater detail with reference to FIGS. 3 to 7. Each air duct 50, 52 has an outer casing 54 which delimits the respective air duct 50, 52. The outer casing 54 is formed by a solid wall made from a plastics material or other material suitable for the manufacture of this type of component. It is the outer casing 54 which is visible in FIG. 5. Inside the outer casing 54, within each branch of the ducting 90, lies a perforated wall member 56. One of the perforated wall members 56 is shown in FIGS. 6 and 7. Each perforated wall member 56 follows the shape of the outer casing 54 of the respective air duct 50, 52, but has slightly smaller dimensions than the outer casing 54. This allows the perforated wall members 56 to extend along each air duct 50, 52 whilst leaving a small gap between the outer casing 54 and the perforated wall member 56.

Each perforated wall member 56 has two opposing perforated walls 56*a*, 56*b* which are joined by side walls 56*c* so that the perforated walls 56*a*, 56*b* can be formed integrally with one another. Flanges 56*d* are formed at either end of the perforated wall members 56 to assist with the correct positioning of the perforated wall members 56 within the outer casings 54.

Perforations 58 are formed in each of the perforated walls 56*a*, 56*b* as shown in FIGS. 6 and 7. Each perforation 58 is elongate in shape and has a length which is significantly greater than its width. In the embodiment shown, the length of the majority of the perforations 58 is at least ten times the width of the respective perforation and is more preferably at least fifteen times its width. This arrangement provides an advantage in that the total area of the perforations 58 is relatively large whilst the strength of the perforated wall member 56 is maintained. Each end of each perforation 58 is generally semi-circular in shape.

It will also be seen from FIGS. 6 and 7 that the arrangement of perforations in each perforated wall 56*a*, 56*b* is such that each elongate perforation 58 extends generally in the same direction of the airflow along the relevant air duct 50, 52. Specifically, the perforations 58 closest to the centre of the perforated wall member 56 extend generally parallel to the axis 57 thereof, whilst the perforations 58 further from the centre of the perforated wall member 56 are inclined so as to lie at an angle to the axis 57.

The perforations 58 formed in each pair of opposing walls 56*a*, 56*b* are arranged so as to be aligned with one another.

More specifically, in each air duct 50, 52, the perforations in the innermost perforated wall 56*a* are aligned with the perforations 58 in the outermost perforated wall 56*b*. By "aligned", we mean that, at any point along the respective air duct 50, 52, the positions of the perforation 58 in the opposing walls match one another.

The perforations 58 extend substantially all the way along each perforated wall 56*a*, 56*b* between the flanges 56*d* at each end of the perforated wall member 56.

The gap formed between the outer casing 54 of each air duct 50, 52 and the adjacent perforated wall 56*a*, 56*b* is filled with a sound-absorbing material 59. In effect, the sound-absorbing material 59 is sandwiched between the outer casing 54 and the relevant perforated wall 56*a*, 56*b*. In this embodiment, the sound-absorbing material 59 is a polyester-based foam, for example, a polyester polyeurythane foam of 30 to 35 kg/m$^3$ density and with a cell size of 50 to 65 PPI (pores per inch). Other advantageous characteristics include a compression set of at least 10% and high thermal tolerance. A suitable sound-absorbing material is sold under the brand name Fireflex S305. Other foam materials having similar characteristics can also be used, as can fibrous textiles such as polyester matting, felt or kapok. Other open weave or open pore materials with appropriate characteristics can be used.

The sound absorbing material 59 is provided in pads having a thickness of 5 mm. In the embodiment, the gap between the outer casing 54 and the perforated wall member 56 is 4 mm. Hence, when the pad of sound-absorbing material 59 is in position, the sound-absorbing material is compressed between the outer casing 54 and the perforated wall member 56. This ensures that the sound-absorbing material is reliably maintained in contact with both the perforated wall 56*a*, 56*b* and the outer casing 54 so as to maximise the sound reduction in the drying apparatus. The pads of sound-absorbing material 59 are held in place in part by the flanges 56*d* located at either end of each perforated wall member 56.

The hand dryer 10 described above operates in the following manner. When a user's hands are first inserted into the cavity 30 through the cavity entrance 32, the sensors 64 detect the presence of the user's hands and send a signal to the motor to drive the fan 40. The fan 40 is thus activated and air is drawn into the hand dryer 10 via the air inlet 44 at a rate of approximately 20 to 40 litres per second, preferably at least 25 to 27 litres per second and more preferably air is drawn into the hand dryer at a rate of 31 to 35 litres per second. The air passes through the filter 46 and along the fan inlet 42 to the fan 40. The airflow leaving the fan 40 is divided into two separate airflows; one passing along the front air duct 50 to the slot-like opening 60 and the other passing along the rear air duct 52 to the slot-like opening 62.

As the airflow passes along the air ducts 50, 52, the aeroacoustic noise generated thereby is absorbed by the sound-absorbing material 59. The sound waves are allowed to pass through the perforation in the perforated wall members 56 and into the sound-absorbing material 59. However, since the volume between the outer casing 54 and the perforated wall member 56 is closed, the airflow remains inside the perforated wall member 56 without entering the said volume to any significant extent.

The airflow is ejected from the slot-like openings 60, 62 in the form of very thin, stratified sheets of high velocity, high pressure air. As the airflows leave the slot-like openings 60, 62, the air pressure is at least 8 kPa, preferably at least 15 kPa and preferably approximately 22 to 23 kPa. Furthermore, the speed of the airflow leaving the slot-like openings 60, 62 is at least 80 m/s and preferably at least 100 or 150 m/s, more preferably approximately 180 m/s. Because the size of the slot-like opening 62 located at the end of the rear duct 52 is greater than the size of the slot-like opening 60 located at the end of the front duct 50, a larger volume of air is emitted from the duct 52 than from the duct 50. This provides a greater mass of air for drying the backs of the user's hands which is advantageous.

The two thin sheets of stratified, high velocity, high pressure air are directed towards the surfaces of the user's hands which, during use, are inserted fully into the cavity 30 and are subsequently withdrawn from the cavity 30 via the cavity entrance 32. As the user's hands pass into and out of the cavity 30, the sheets of air blow any existing water off the user's hands. This is achieved reliably and effectively because of the high momentum of the air leaving the slot-like openings 60, 62 and because the airflow is evenly distributed along the length of each slot-like opening 60, 62.

Each stratified sheet of air is directed towards the wall of the cavity 30 which is remote from the slot-like opening through which the respective sheet of air is emitted. Because the slot-like openings 60, 62 are also inclined towards the lowermost end of the cavity 30, the emitted airflows are directed into the cavity 30. This reduces the risk of turbulent air movement being felt by the user outside the casing, eg in the user's face.

It is envisaged that it will take only a small number of "passes" of the hand dryer described above to dry a user's hands to a satisfactory degree. (By "pass", we mean a single insertion of the hands into the cavity and subsequent removal therefrom at a speed which is not unacceptable to an average user. We envisage that a single pass will have a duration of no more than 3 seconds.) The momentum achieved by the airflows is sufficient to remove the majority of water found on the surface of the user's hands after washing during a single pass.

The water removed by the airflows is collected inside the cavity 30. Each airflow will rapidly lose its momentum once it has passed the user's hands and the water droplets will fall to the lower end of the cavity 30 under the forces of gravity whilst the air exits the cavity 30 either through the cavity entrance 32 or via the open sides of the cavity 30. The water, however, is collected by the drain 38 and passed to a reservoir (not shown) where it is collected for disposal. The reservoir can be emptied manually if desired. Alternatively, the hand dryer 10 can incorporate some form of water dispersal system including, for example, a heater for evaporating the collected water into the atmosphere. The means by which the collected water is dispersed does not form part of the present invention.

Figure 8:
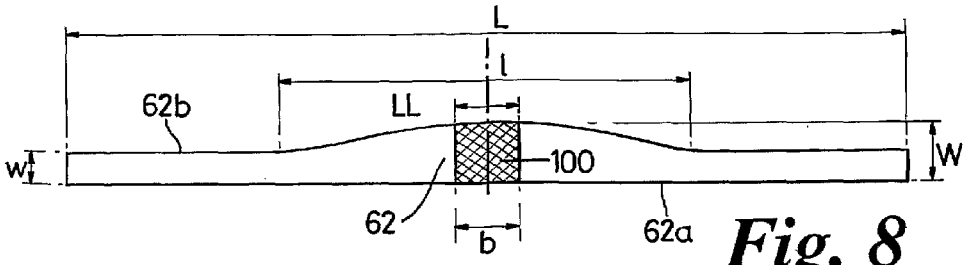
FIG. 8 is a schematic front view of an opening emitting airflow into the cavity and forming part of a hand dryer according to a second embodiment of the invention.

The second embodiment of the invention is identical to the embodiment described above in all respects save that of the width of the slot-like opening 62 located at the end of the rear duct 52. Whereas the width $W_2$ of the slot-like opening 62 is constant in the first embodiment, it is not constant in the second embodiment. A front view of the slot-like opening (shown schematically for clarity) is shown in FIG. 8.

In this second embodiment, the lower edge 62*a* of the slot-like opening 62 is straight, as it is in the first embodiment. However, the upper edge 62*b* of the slot-like opening 62 is curved in the central area 1 thereof so that the width of the slot-like opening 62 increases from a minimum width w to a maximum width W. Outside the central area 1, the minimum width w of the slot-like opening 62 is constant and the preferred value of the minimum width w is 0.4 mm. The preferred value of the maximum width W is less than twice the value of the minimum width w, in this case 0.7 mm.

In this embodiment, the central area 1 covers substantially one half of the entire length L of the slot-like opening 62. The distance between the upper edge 62*b* and the lower edge 62*a* begins to increase at a point approximately one quarter of the way along the slot-like opening 62 from either end thereof. The shape of the upper edge 62*b* is symmetrical and takes the form of a smooth curve having its highest point in the centre of the slot-like opening.

In use, the hand dryer according to the second embodiment is capable of emitting an increased mass of air through the centre of the rear slot-like opening 62 in comparison to the first embodiment. This is advantageous because the area of the hands which is often most difficult to dry using this type of hand dryer is that around the thumbs and forefingers. The emission of an increased mass of air in that region of the hands improves the ability of the dryer to dry the hands evenly. In use however, the increased mass of air emitted may result in a greater amount of motor noise emitted by the drying apparatus. The increased noise may be unpleasant for a user. In the further preferred embodiment a silencing insert or block is positioned inside the rear slot-like opening. The effect of the blockage is to reduce the volume of aero-acoustic noise emitted by the apparatus. There is a reduction in mean noise and the performance of the apparatus in terms of emitted noise is more consistent.

The features of the blocking insert 100 will now be described in greater detail with reference to FIGS. 8 and 9. The slot-like opening 62 is closed and blocked in the centremost area LL thereof. The insert 100 has a breath b and a width W dimensioned to fit from the upper edge 62*a* of the slot-like opening 62 to the lower edge 62*a* of the slot-like opening 62. In use, the insert has the effects of blocking the air flow emitted from the drying apparatus in the centremost area LL. In this embodiment the insert 100 is fixed to both upper edge 62*a* and the lower edge 62*a* of the slot-like opening 62 and extends into the region immediately downstream of the opening. The insert 100 is tapered and smooth to minimise any frictional losses and suppress turbulent flow and noise generation. In use, the air flow in the centremost 10 mm portion of the slot-like opening is blocked with an insert having a breath b of 10 mm.

Figure 9:
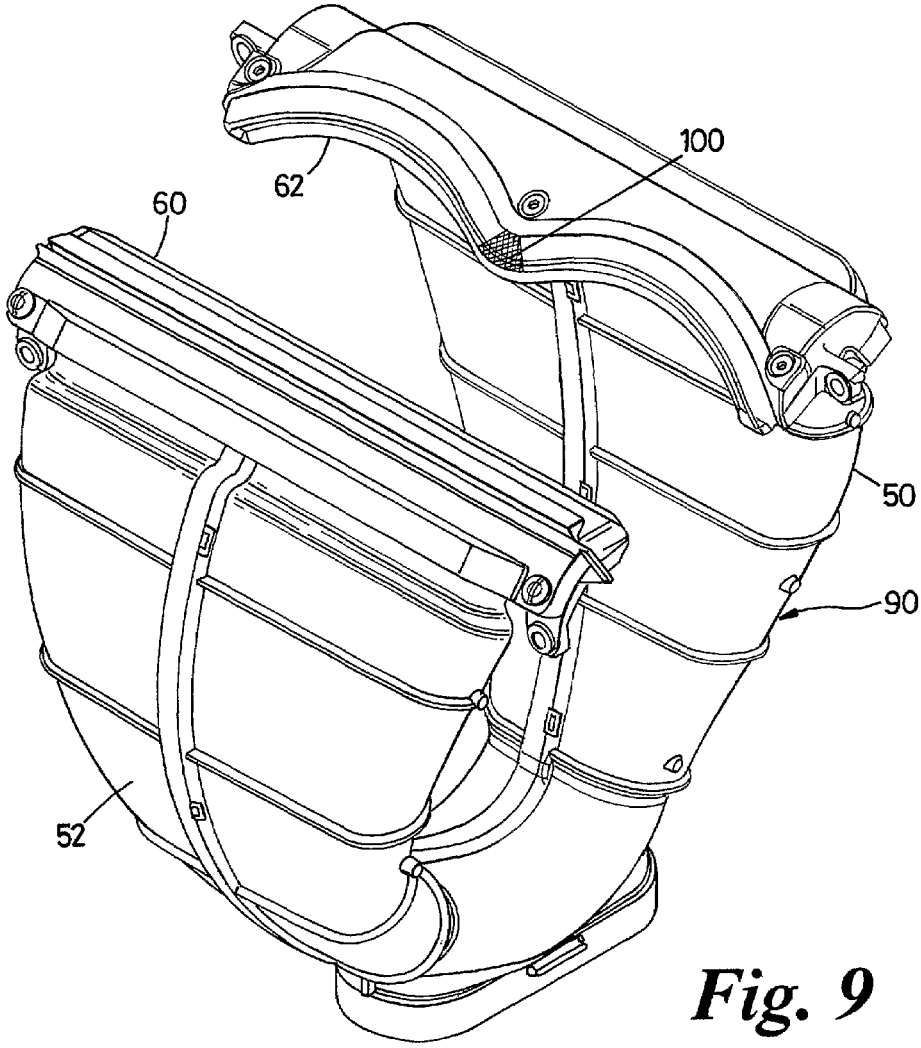
FIG. 9 is a perspective view of the ducting a forming part of the hand dryer of FIG. 1 according to the second embodiment of the invention.

It will be appreciated that, in this second embodiment, the width of the rear slot-like opening 62 can be varied by altering the shape of either or both edges and that the precise shape of the slot and the precise shape and form of the blocking insert are not limited to that shown in FIG. 8 or 9. For example, the breath b of the insert may vary from 5 mm-25 mm. For example, the insert may be formed close to the exit point of the slot-like opening only or may extend upstream and into the ducting some distance. Alternatively the insert may be used to reduce the level of noise emitted from drying apparatus having a slot-like opening with a constant width. The insert may be comprised of any material, preferably non-porous material such as plastic or skinned foam. The insert may be a separate component or may be formed with the duct itself.

In a further alternative embodiment, the slot-like openings 60*a*, 62*a* can be arranged so that the sheets of air which are emitted therefrom are directed generally along planes which are substantially parallel to one another. This minimises the amount of turbulent flow present inside the cavity 30 whilst the drying apparatus is in use.

The invention is not intended to be limited to the precise detail of the embodiment described above. Modifications and variations to the detail which do not alter the scope of the invention will be apparent to a skilled reader. For example, different sound-absorbing materials can be used, as can alternative shapes and arrangements of the elongate slots provided in the perforated walls. The thickness of the sound-absorbing material can be increased if desired, as can the amount of compression applied to the sound-absorbing material. Indeed, if space constraints allow, the gap between the perforated wall member and the outer casing of the air ducts will be made as large as possible. It will also be appreciated that the invention can be used in other forms of drying apparatus.

The invention claimed is:

1. A drying apparatus comprising:

a casing, a cavity formed in the casing for receiving an object, a fan located in the casing and capable of creating an airflow, a motor provided in the casing for driving the fan and ducting for carrying the airflow from the fan to at least one opening arranged to emit the airflow into the cavity, wherein the ducting comprises at least one air duct having a wall in which perforations are provided, and a layer of sound-absorbing material is disposed against the perforations from an outer side of the wall so as to direct the airflow along an inner side of the wall to the at least one opening.

2. The drying apparatus as claimed in claim 1, wherein the perforations in the wall are elongate and extend generally in the direction of the airflow along the air duct.

3. The drying apparatus as claimed in claim 2, wherein the length of each perforation is significantly larger than the width thereof.

4. The drying apparatus as claimed in claim 1, 2 or 3, wherein the air duct has two generally opposed walls and perforations are provided in both opposing walls.

5. The drying apparatus as claimed in claim 4, wherein the perforations in the opposing walls are substantially aligned with one another.

6. The drying apparatus as claimed in claim 1, 2 or 3, wherein the perforations in the wall extend substantially along the entire length thereof between the fan and the opening.

7. The drying apparatus as claimed in claim 1, 2 or 3, further comprising a second casing provided on the side of the sound-absorbing material remote from the wall.

8. The drying apparatus as claimed in claim 7, wherein the sound-absorbing material is compressed between the wall and the second casing.

9. The drying apparatus as claimed in claim 1, 2 or 3, wherein the sound-absorbing material is a polyester-based foam.

10. The drying apparatus as claimed in claim 1, 2 or 3, wherein the ducting has more than one branch and sound-absorbing material is provided in each branch of the ducting.

11. The drying apparatus as claimed in claim 1, 2 or 3, further comprising an obstruction adapted and arranged in the ducting so as to obstruct and deflect a portion of the airflow in the ducting.

12. The drying apparatus as claimed in claim 11, wherein the obstruction is arranged at a centre portion of a branch of the ducting.

13. The drying apparatus as claimed in claim 11, wherein the obstruction extends between two generally opposed walls of the at least one air duct.

14. The drying apparatus as claimed in claim 11, wherein the obstruction comprises a separate component located within the air duct.

15. The drying apparatus as claimed in claim 11, wherein the obstruction is formed as an integral component with the air duct.

16. The drying apparatus as claimed in claim 11, wherein the obstruction obstructs a portion of the air duct having a breadth of at least 5 mm.

17. The drying apparatus as claimed in claim 1, 2 or 3, wherein the apparatus is a hand dryer.

* * * * *